US008486229B2

(12) United States Patent
Pietikäinen et al.

(10) Patent No.: US 8,486,229 B2
(45) Date of Patent: Jul. 16, 2013

(54) DEVICE FOR DRYING AND TREATING A TISSUE PAPER WEB

(75) Inventors: Reijo Pietikäinen, Järvenpää (FI); Jani Hakola, Nummenkylä (FI); Mika Viljanmaa, Helsinki (FI); Jari Ilomäki, Helsinki (FI)

(73) Assignee: Metso Paper, Inc., Helsinki (FI)

( * ) Notice: Subject to any disclaimer, the term of this patent is extended or adjusted under 35 U.S.C. 154(b) by 3 days.

(21) Appl. No.: 13/322,407

(22) PCT Filed: May 26, 2010

(86) PCT No.: PCT/FI2010/050424
§ 371 (c)(1),
(2), (4) Date: Dec. 9, 2011

(87) PCT Pub. No.: WO2010/136651
PCT Pub. Date: Dec. 2, 2010

(65) Prior Publication Data

US 2012/0125554 A1 May 24, 2012

(30) Foreign Application Priority Data

May 27, 2009 (FI) ..... 20090205 U

(51) Int. Cl.
*D21F 5/18* (2006.01)
*F26B 13/04* (2006.01)
*B31F 1/14* (2006.01)

(52) U.S. Cl.
USPC ..... 162/280; 162/281; 162/375

(58) Field of Classification Search
USPC ..... 162/111, 204–207, 280, 281, 290, 162/358.5, 359.1, 375, 376; 34/419, 422, 34/444, 459, 611, 618, 623
See application file for complete search history.

(56) References Cited

U.S. PATENT DOCUMENTS 3,367,035 A * 2/1968 Tomlinson ..... 34/359
4,249,992 A * 2/1981 Wells ..... 162/198
4,622,758 A * 11/1986 Lehtinen et al. ..... 34/392
4,899,461 A * 2/1990 Lehtinen ..... 34/392

(Continued)

FOREIGN PATENT DOCUMENTS

CH 581748 A5 11/1976
WO 8400984 A1 3/1984

(Continued)

OTHER PUBLICATIONS

CH 581748, Nov. 1976, English language Abstract.*

(Continued)

*Primary Examiner* — Eric Hug
(74) *Attorney, Agent, or Firm* — Stiennon & Stiennon

(57) ABSTRACT

A device for drying and treating a fiber-based moving fiber web (1) in a machine intended for producing tissue paper includes a metal belt (2) which is arranged to support the fiber web (1) and to transfer the fiber web (1) in the machine direction and which metal belt (2) is arranged as a continuous rotating cycle, at least one roll (3) the shell of which is in contact with the metal belt (2) arranged to rotate around, which roll (3) is for supporting and/or controlling the metal belt (2), and at least one counter element (5) arranged to create a contact area outside the metal belt (2) between the metal belt (2) and the counter element (5) for a process zone (6), via which process zone (6) the fiber web (1) is arranged to travel when using the device.

15 Claims, 3 Drawing Sheets

U.S. PATENT DOCUMENTS

| | | | | | |
|---|---|---|---|---|---|
| 6,004,430 | A | * | 12/1999 | Ilvespaa et al. | 162/207 |
| 6,154,981 | A | | 12/2000 | Heikkila et al. | |

FOREIGN PATENT DOCUMENTS

| | | | | |
|---|---|---|---|---|
| WO | WO 84/00984 | | * | 3/1984 |
| WO | 02086234 | A1 | | 10/2002 |
| WO | 03064761 | A1 | | 8/2003 |
| WO | 2010136651 | A1 | | 12/2010 |

OTHER PUBLICATIONS

International Search Report for PCT/F12010/050424 , Sep. 16, 2010.
International Preliminary Report on Patentability for PCT/FI2010/050424 , Sep. 7, 2011.
Reply to Written Opinion for PCT/FI2010/050424 dated Dec. 17, 2010.

* cited by examiner

DEVICE FOR DRYING AND TREATING A TISSUE PAPER WEB

CROSS REFERENCES TO RELATED APPLICATIONS

This application is a U.S. national stage application of International App. No. PCT/FI2010/050424, filed May 26, 2010, the disclosure of which is incorporated by reference herein, and claims priority on Finnish App. No. U20090205 filed May 27, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a device and a method in the production of a fiber web and particularly relates to a device in the production of a fiber web for drying the fiber web by utilizing a moving metal belt.

An equivalent type of prior art is represented by patent specification WO 03/064761 A1 which describes a calender based on a metal belt. This specification can be considered the closest description of prior art.

Furthermore, a prior-art yankee cylinder is depicted in specification U.S. Pat. No. 6,154,981 which describes intensifying the heating of a hood covering the yankee cylinder.

In a tissue machine, a fiber web is dried on the shell of a large cylinder, i.e. the yankee cylinder. In addition to operating as the transfer path of heat for drying the fiber web, the yankee cylinder has three other functions: conveying the fiber web during drying, operating as a roll during hot pressing and operating as a base in the creping process.

Commonly, the drying of the fiber web takes place through several repeated stages which include evaporation, removal of evaporated steam from the surface of the dryer, condensation, and capillary drifting of water onto the evaporation surface. This process occurs in the same way on that outer surface which is against the hood and in which bi-directional flow takes place through evaporation and drifting. The process continues and becomes stable until the sole remaining water is bound in the fibers. The final drying is slower and requires more energy.

The creping of the fiber web is a precisely manageable operation which requires a controlled balance between the adhesion of the fiber web on the cylinder surface, the physical properties of an uncreped fiber web and forces applying to a doctor blade. The creping mainly takes place by means of the doctor blade from the surface of the yankee cylinder using suitable creping geometry in the settings of the doctor blade. The fiber web folds into slightly cross-directional creases and its machine-directional length shortens for 10-25 percentages. The machine-directional contraction is considered by setting the speed of the winder equivalently to a lower speed. The creping increases the bulk of the fiber web and improves softness, absorbency and stretch. The creping decreases tensile strength. In the case of tissue, its final quality and particularly its softness are greatly dependent on creping.

In dry-creping tissue machines, the fiber web is creped on the dryer when the dry content is 93-98 per cent. Machines in which the creping occurs in the dry content of less than about 90 per cent are called wet-creping machines. These machines further include a second drying unit.

The drying capacity of the tissue machine is often limited by the size of the yankee cylinder. The speeds of the tissue machines have increased along with twin-wire formers. The higher drying capacity has led to the use of larger yankee cylinders. Now, the diameters of yankee cylinders in tissue machines of the highest speeds are in the range of 5,500 mm.

SUMMARY OF THE INVENTION

An object of the present invention is to diminish or even eliminate the above problems of prior art.

A particular object of the present invention is to provide an arrangement with which the drying of the fiber web is possible without the technique based on the yankee cylinder.

The exemplifying embodiments and advantages mentioned in this text relate to the device according to the invention when applicable, even though it is not always stated separately.

An advantage of the invention is the quality of the produced fiber product, because the surface quality of the fiber product when drying is based on the topography of the corresponding surface which is copied from the metal belt to the fiber product. The quality of the fiber product can be affected in the thermo roll nip of the final stage when finishing the surface quality.

A structural advantage is the elimination of limitations entailed by the yankee cylinder, such as, in place of the yankee cylinder surface, there is a metal belt surface which is smoother and the maintenance of which is easier when smooth and clean. Cleansing is also possible during run by means of an abrasive felt. The properties of the steel belt surface are different from those of a cast steel or cast iron cylinder. Structurally, the use of space is intensified, the web draw and the threading can be implemented with more versatile web draws, the production line of the fiber product or its section can be shortened, whereby e.g. other structure groups can be offered extra space for use when required.

The drying of the fiber product with the arrangement according to the invention is effective, because the device enables efficient heat transfer into the fiber product when the fiber web is well adhered on the surface moving it. Furthermore, heat does not escape into the structures of the device according to the invention but is applied on the conveying surface and the fiber product. The conveying surface can be heated from 100 degrees C. to at least 350 degrees C. which is higher than measured surface temperatures of the yankee cylinder.

The tendency of the fiber web to dry fast on a conveying hot surface according to the invention is smaller than on a cylinder surface. Depending on the layout of the web draw, the contact time between the surface and the fiber web can be long, longer than in the arrangement based on the yankee cylinder.

By means of the device, it is possible to increase the web speed, because the metal belt can be heated to a considerably higher temperature than the surface of the yankee cylinder and the heat transfer occurs more efficiently to the fiber web.

The construction, transport and maintenance costs of the device are lower than those of the arrangement based on the yankee cylinder.

By means of the device, it is possible to avoid the pressure vessel inspection required by the yankee cylinder due to high-pressure steam prevailing in the yankee cylinder.

The spare part supply of the device requires a smaller space, because the space requirement of the conveying surface according to the invention is smaller than the auxiliary cylinder of the yankee cylinder.

The invention relates to a device for drying and treating a fiber-based moving fiber web in a machine intended for producing tissue paper, which device includes a metal belt which is arranged to support the fiber web and to convey the fiber web in the machine direction, and which metal belt is arranged as a continuous rotating cycle. Furthermore, the device includes at least one roll the shell of which is in contact with the metal belt arranged to rotate around, which roll is for supporting and/or controlling the metal belt. Additionally, the device includes at least one counter element arranged outside the metal belt for creating a contact area between the metal belt and the counter element for a process zone, via which process zone the fiber web is arranged to travel when using the device. The invention employs at least one pressure roll outside the metal belt in a nip contact with the metal belt, by means of which nip contact the fiber web is arranged to adhere to in the metal belt.

Adhering the fiber web refers to creating a reliable contact between the metal belt and the fiber web, whereby the metal belt has control and support in relation to the fiber web, but of which adherence the fiber web is detachable of the metal belt for the next process stage or for conveying to it.

In this specification, the fiber web refers to a fiber web arranged movable. The fiber web is advantageously of tissue paper.

The fiber web is delivered carried by the fabric the dry content of the web being 12-18% and guided onto the surface of the metal belt. In the dewatering of the fiber web, it is possible to use one or two nips run by the same fabric cycle. The first press nip usually utilizes a suction roll to form the nip. The roll of the second nip is a blind bored roll, if the second nip is used. Linear load of the first nip is typically 80-85 kN/m and that of the second 85-90 kN/m. Because the diameter of the roll of the second press nip is usually smaller than the diameter of the roll of the first press nip, pressure distribution and maximum pressure in the second nip are higher than those of the first. This is substantial for the operation of the press. In an underpressure section of the first press roll nip, it is possible to install a steam air humidifier for heating the fiber web and for lowering viscosity. The purpose of this is to improve dewatering. Some steam air humidifiers include control zones in the cross-direction for controlling the uniformity of moisture in the fiber web.

The press arrangement with one nip can advantageously be used in new tissue machines. The use of one nip leads to greater thickness and better softness of the fiber web. The tensile strength of the fiber web is lower. The dry content of the fiber web is at a lower level, about 2-3% lower than in the arrangement with two nips. As the covering angle and the drying power of the hood can be increased when there is no second nip, the production capacity is at the same level with the embodiment of two nips. In an embodiment, a shoe press can replace the traditional use of the press nip. The shoe press nip against the metal belt enables producing tissue paper with a higher bulk or higher production efficiency. This also improves crowning (the cross-directional contact of the nip) between the press roll and the metal belt.

Heat conduction starts from the first contact moment on the hot surface of the metal belt and continues as long as the fiber web is in contact with the surface conducting heat. Heat transfer and heat radiation occur on that area which is covered by the hood. Drying is very intensive with the yankee cylinder where the drying power is 150-240 kg $H_2O/hm^2$ compared to conventional drying on the drying cylinder section, 20-30 kg $H_2O/hm^2$. During drying, the fiber web adheres on the metal belt and is not exposed to the edge shrinkage phenomenon in an equivalent way to other dryers. This also means that tissue machines mainly have no free draws before the fiber web is almost totally dry.

The drying of the fiber web in a high-speed tissue machine is a very short and intensive process. Efficient heat transfer from the metal belt to the fiber web is important for drying power, but it is possible that a greater part of drying in the tissue machine takes place by means of the hood than by means of the metal belt.

The hood is advantageously an impingement hood, whereby the impingement hood provides a considerable intensification in drying power. Time used for the drying of tissue paper in effective high-speed machines can be of the order of 0.3 seconds and drying power equivalent to it can rise to the level of 250 kg $H_2O/hm^2$.

In connection with the metal belt, the tissue machines can utilize three doctor blades of which a creping doctor blade is advantageously in the middle. In front of the creping doctor blade is usually a shutdown doctor blade which is used when replacing the creping doctor blade. A cleaning doctor blade is often utilized as the last doctor blade for the cleansing of the surface of the metal belt, for removing fibers and extra accrued coating from the surface of the metal belt.

The metal belt can also be cleaned with an abrasive felt which is advantageously utilized when recycled fiber and/or chemimechanical pulp is used in the production of the fiber web. The pulp types in question can cause the dirtying of the metal belt in the machine. Dirtying in the rotating metal belt is easily cumulative, unless its accumulation cannot be interfered with. Dirtying makes the runnability of the machine more difficult if it returns from the metal belt back to the web. The abrasive felt is advantageously arranged to be supported as traversable over the whole web width. Implementing the cross-directional motion has its own drive motor and rotating the abrasive felt has its own drive motor. As the abrasive felt, it is possible to use known abrasive felts intended for grinding metal surfaces. In addition to the abrasive felt, it is also possible to use pastes and such intended for grinding to improve the final result.

In addition to the drying surface of the metal belt, the hood can include hot gas blowing the temperature of which can rise to 500 degrees C. for intensifying the drying. Using the metal belt can provide energy savings, because a lower temperature provides the same drying result and/or the speed of the fiber-web machine can be increased.

The drying of tissue paper occurs by evaporation. When the wet fiber web is pressed on the hot surface of the metal belt, a short high heat transfer takes place until the fiber web reaches the stabilizing state in the temperature of about 90 degrees C. This is the preheating stage.

Compared to other paper grades, tissue is thin and the structure of the fiber web is porous. Most of the evaporation created on the surface of the metal belt can penetrate the open structure of the fiber web without condensing. The hot press of the fiber web provides a strong adhesion on the drying surface and high heat transfer.

To provide creping, the surface of the metal belt has adherence force of some quantity for adhering the fiber web on the surface of the metal belt. In wet creping, the force is provided by means of a water film. In the moisture of below 70%, the water film is formed non-uniform. The adhesion has to be created in various ways, such as e.g. based on the material properties of paper pulp. The property can be artificially improved at the wet end by inserting additives in the pulp or more commonly by spraying directly on the surface of the metal belt.

From the viewpoint of creping, the adhesion force of the fiber web on the surface of the metal belt is an important factor. When creping occurs, the adhesive bond opens between the fiber web and the metal belt or splitting occurs within the fiber web. The force of the doctor blade provides the opening of the adhesion between the fiber web and the metal belt, which opening has to be between coating possibly accumulated on the fiber web and the surface of the metal belt. If adhesion is low in relation to cohesiveness within the fiber web, opening occurs close to the surface of the metal belt. If adhesion is high compared to cohesiveness, part of the fiber web can remain on the surface of the metal belt. The splitting can occur randomly and it can cause a break in the web. The adhesion being high, there necessarily is no problem. The problem is mainly caused by the relation between adhesion and cohesion.

The adhesion between the fiber web and the surface of the metal belt below it is an important variable, because it affects the creping properties and the properties of the fiber web. There exists a great dependency between the web tension after the creping doctor blade and the adhesion force on the surface of the metal belt. The dryer based on the metal belt can also be dimensioned for the production of light tissue and towel paper where the fiber web is creped on the surface of the metal belt. In these cases, the speed of the machine is conventionally very high, even 2,200 m/min. For these machines, the heat capacity of the dryer based on the metal belt is a substantial feature.

BRIEF DESCRIPTION OF THE DRAWINGS

The invention will next be described in more detail with reference to the enclosed schematic figures.

DESCRIPTION OF THE PREFERRED EMBODIMENTS

Figure 1:
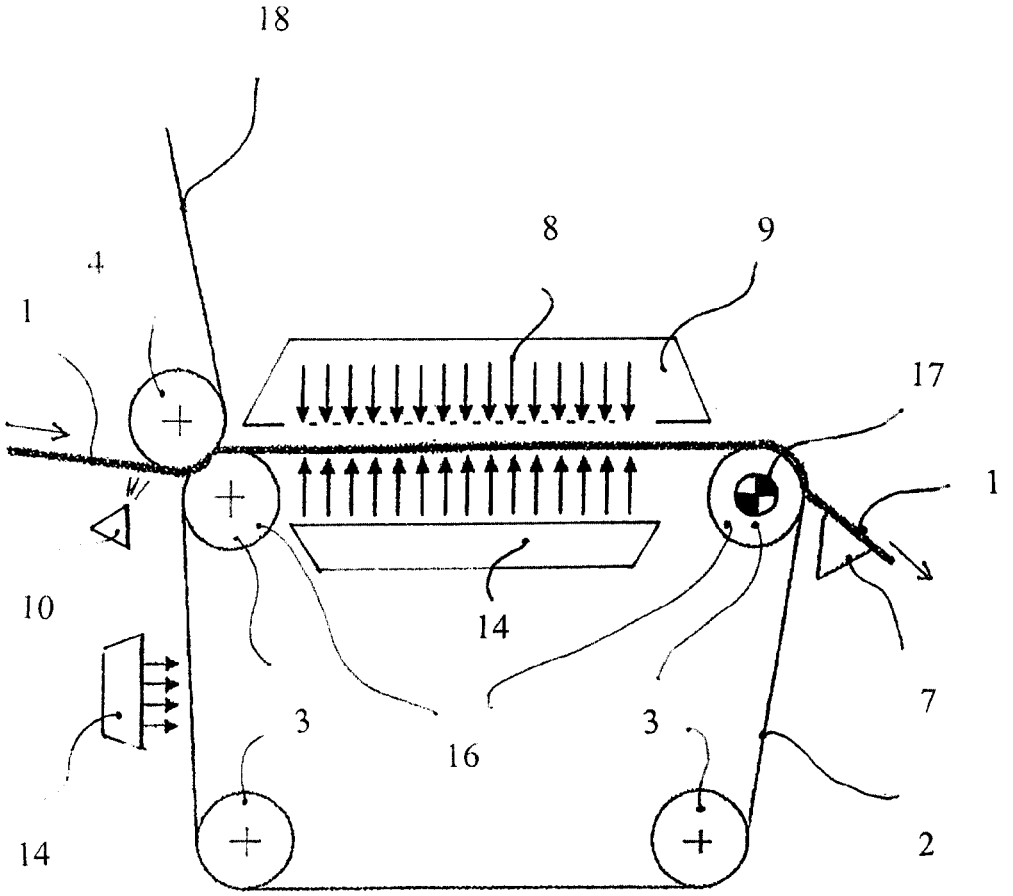
FIG. 1 shows a side view of a device according to the invention.

FIG. 1 shows a first embodiment of the invention in which a metal belt 2 conveying a fiber web 1 is arranged rotatable via four rolls 3. In the figure, the delivery of the fiber web 1 is from the left supported by a fabric (e.g. a wire, a felt) to the device where the fiber web 1 transfers to be carried by the metal belt 2 via a nip formed by a pressure roll 4. The delivery of the fiber web 1 can be arranged such that the fiber web 1 is first supported on the shell of the pressure roll 4 directly or the fabric 18 being in between and, then supported by the shell, it transfers to the metal belt 2.

Before guiding the fiber web 1 to the nip, the fiber web 1 can be wet with a humidifier 10. After the nip, the combined draw of the fiber web 1 and the metal belt can be heated, even on both sides in accordance with the figure. Below the metal belt 2 is heated the metal belt 2, above the fiber web 1 is heated the actual fiber web 1 with air blowings. After the heating stage, the fiber web 1 conveyed by the metal belt 2 comes under the control of the shell of the next roll 3, after which roll 3, the fiber web 1 is detached of the metal belt 2 by means of a doctor blade 7. The doctor blade 7 can be a doctor blade 7 utilized in creping when the fiber web 1 is of tissue paper. After the detachment, the fiber web 1 continues forward to the right in the figure, the metal belt 2 continues down in accordance with the metal belt rotation to return controlled by the shell of the other two rolls 3 back to the nip formed by the pressure roll 4. The rolls 3 shown in the figures can be heated either internally or with external roll heaters 16. Furthermore, the metal belt 2 can be heated by induction, advantageously before the nip formed by the pressure roll 4.

To implement the metal belt cycle, at least one roll 3 of the four inner rolls 3 is arranged with a possibility for motion for tightening the metal belt 2 and at least one roll 3 of the four is arranged with a possibility for control of the metal belt 2. The above features can be implemented for the same roll 3. Furthermore, the pressure roll 4 is arranged with a possibility for motion to close and load the nip. It is possible to combine the loading of the pressure roll 4 with force measurement. The above possibilities for motion can also be combined with location (i.e. position) measurements. The position measurement controlling the travel of the metal belt 2 monitors the position of the metal belt in the machine direction, i.e., its task is to keep the metal belt 2 at substantially the same point without offset. Into connection with one roll 3 in the metal belt cycle can also be arranged a system measuring the tension of the metal belt 2 and the temperature measurement of the metal belt 2 which can be implemented as full-width profile measurement in relation to the fiber web 1. The nip formed by the pressure roll 4 against the metal belt 2 can be arranged such that the fiber web 1 is arranged to travel via the nip or, in addition to the fiber web 1, the fabric conveying the fiber web 1 is also arranged to travel via the nip.

Figure 2:
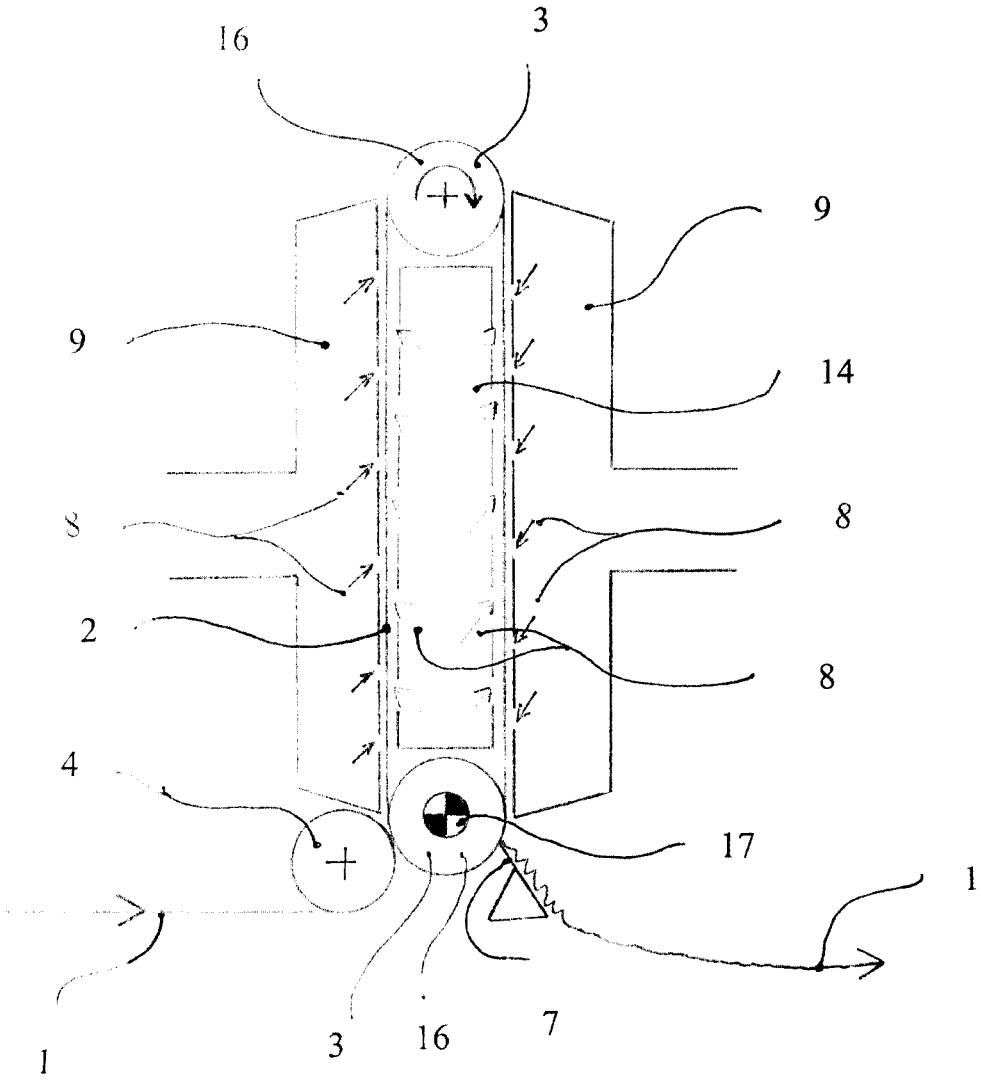
FIG. 2 shows a side view of a second embodiment of the device according to the invention.

FIG. 2 shows a second embodiment of the invention in which the metal belt cycle is arranged shorter of its principal dimensions in the horizontal direction (machine direction) than in the vertical direction. Thus, the horizontal principal dimension of the cycle of the metal belt 2 is smaller than the vertical principal dimension. The principal dimension refers to the distance between the rotation axes of the outermost rolls 3 in the metal belt cycle in the horizontal or vertical direction. In this arrangement, savings in space are considerable compared to previous in the arrangement based on the yankee cylinder. For heating the fiber web 1 is arranged at least one hood 9 outside the metal belt cycle, whereby the active heating area and travel become very effective. The metal belt cycle is implemented by means of two rolls 3. It is also possible to use three or four rolls 3, whereby the tightening and control operations of the metal belt 2 can be decentralized for different rolls 3. The detachment of the fiber web 1 of the metal belt 2 is arranged against the doctor blade 7, which doctor blade 7 has both a possibility for shutdown and implementable creping. The operations can also be divided between several doctor blades 7, whereby it is possible to optimize the properties of the doctor blade 7 for each purpose.

In the space within the cycle of the metal belt 2 are arranged heaters 14 of the metal belt 2, such as e.g. hot air blowings 8.

The layout of the fiber web 1 can also be designed such that the entry and the exit of the fiber web 1 are in the upper part of the device, whereby the metal belt cycle is in a way upside down (the rotation of the layout 180 degrees).

Equivalently, rotating the layout for 90 degrees clockwise or counter clockwise provides a situation which is low of its structure and elongated in the machine direction, which can be an advantageous and interesting solution of its space utilization e.g. in some modernizing targets.

Figure 3:
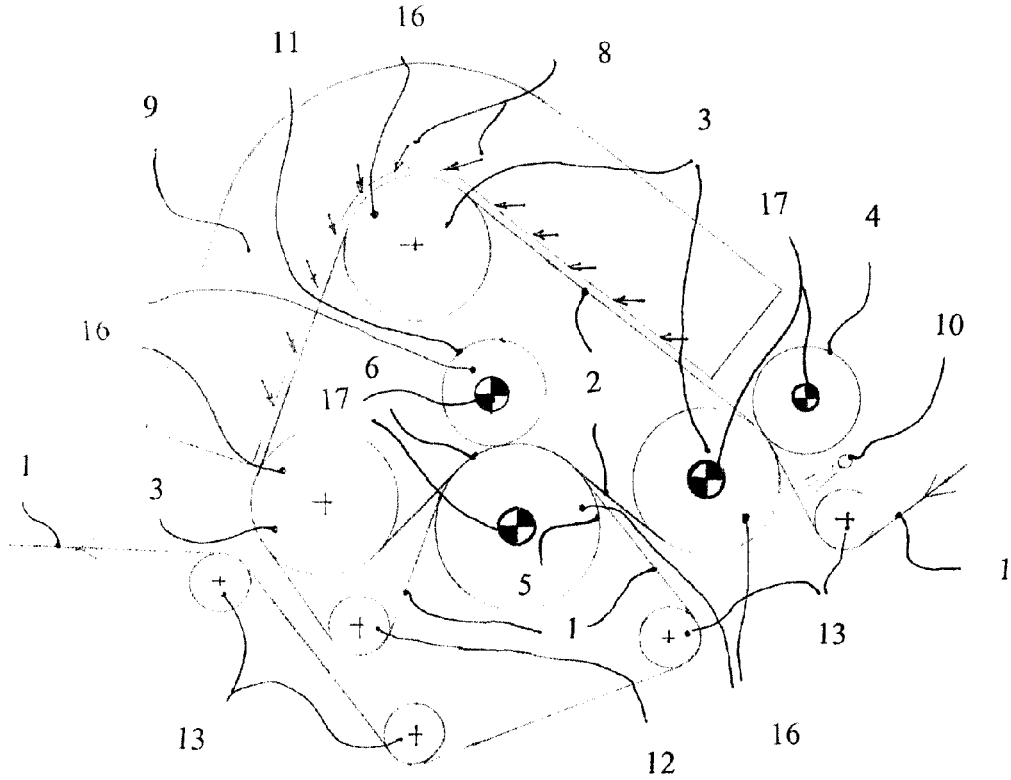
FIG. 3 shows a side view of a third embodiment of the device according to the invention.

FIG. 3 shows a third embodiment of the invention in which the fiber web 1 is delivered from the right via a paper guide roll 13 into the nip formed by the metal belt 2 and the pressure roll 4. The fiber web 1 can be first delivered in contact with the metal belt 2 or the shell of the pressure roll 4 from which it is delivered into the nip. Before guiding the fiber web 1 to the nip, the fiber web 1 can be wet with the humidifier 10. Alternatively, moisturising can be applied on the surface of the metal belt 2. The delivery of the fiber web 1 can also be straight from the direction of the tangent to the nip. After the nip formed by the pressure roll 4, the fiber web 1 is supported by the metal belt 2 where it can be heated by means of a hood 9. The hood 9 is advantageously an impingement hood via which it is possible to blow hot air to intensify the drying. The hood 9 can surround the metal belt cycle curvilinearly past the second roll 3 from which the metal belt 2 rotates downwards onto the third roll 3. After the third roll 3, the metal belt 2 continues its travel towards a process zone 6, but the fiber web 1 is delivered from the third roll 3 onto a fly roll 12 where the fiber web 1 can be spread before guiding it to be treated on the process zone 6. The fiber web 1 rejoins the metal belt 2 before a nip formed by a press roll 11 on the process zone 6, which nip is between the press roll 11 and a counter element 5 and in which nip the fiber web 1 is guided supported by the metal belt 2 such that the fiber web 1 is between the metal belt 2 and the counter element 5.

On the process zone 6, changes occur in the structure and/or surface of the fiber web 1 by means of control parameters. The control parameters can be compression pressure in the thickness direction (z direction) of the fiber web 1, compression pressure distribution in the travel direction of the fiber web 1, temperature, moisture, tension of the fiber web 1, tension of the metal belt 2, length of the nip formed by the metal belt 2 in the travel direction of the fiber web 1, and/or speed difference of the metal belt 2 in relation to the fiber web 1 in the travel direction of the fiber web 1. To form the process zone 6, it is possible to use a thermo roll instead of the counter element 5 or the press roll 11.

By means of controlling actuators 17, e.g. to use the rolls 3 with electric drives, it is possible to implement a small speed difference between the metal belt 2 and the fiber web 1 on the exact level of a desired surface property of the fiber web 1. The actuator 17 is connected to at least one machine element arranged rotatable within the metal belt cycle. Furthermore, the second actuator 17 is connected to a machine element arranged rotatable outside the metal belt cycle, such as the counter element 5.

In the nip between the press roll 11 and the counter element 5, it is particularly possible to rise the maximum value of pressure distribution in the compression pressure distribution. In the case of board and tissue paper, the desired variable is often the bulkiness of the fiber web 1, whereby the aim is to keep the maximum value of the pressure distribution at a relatively low level, and the effective drying capacity of the device is reached primarily by effectively optimizing other control parameters.

After the process zone 6, the fiber web 1 supported by the metal belt 2 continues onto the first roll 3 where the metal belt 2 returns on the shell of the first roll 3 and the fiber web 1 diverges and is guided forward onto the next paper guide roll 13 and, via that, to the next process stage.

In this embodiment, the metal belt cycle is implemented by means of three rolls 3, one press roll 11 and counter element 5. For the web draw, it is possible to use the fly roll 12 before the process zone 6 which is formed in a curvilinear nip between the counter element 5, the metal belt 2 and the press roll 11. With the hood 9, the fiber web 1 is heated into the process temperature before the process zone 6. The metal belt 2 can be heated by induction, an oil-heated roll 3, a steam chamber, electric and gas infra, direct flame heating, direct electric heating, hot gas blowing, a hot liquid chamber, cycle of medium around the cylinder, and conduction. Induction can also be used through the fabric or the fiber web 1 when they are not magnetic.

The counter element 5 is an element against the metal belt 2 against which it is possible to apply force. In the area of the counter element 5, the travel of the fiber web 1 can be arranged in the shape of a curve. The counter element 5 can be e.g. the shoe of a shoe press or a roll 3 or several rolls 3. It can also be a combination of the shoe press and the rolls 3.

Heaters 14, 16 can be located either inside or outside the metal belt cycle. The heaters 14, 16 can heat the fiber web 1 directly or indirectly. With hot air blowings 8, the fiber web 1 can be heated and the blowings can be directed in the forward direction in relation to the travel of the fiber web 1.

The measurement and control arrangements described in the above examples, the arrangements suitable for the controlling and tightening of the metal belt 2 and the loading of the pressure roll 4 are also applicable in other embodiments, even though not particularly mentioned. The same relates to the heating methods and devices of the fiber web 1 and the metal belt 2.

The figures only show one advantageous exemplifying embodiment according to the invention. The figures do not separately depict matters secondary to the main idea of the invention, known as such or evident to those skilled in the art, such as power sources or support structures possibly required by the invention. It is evident to those skilled in the art that the invention is not solely limited to the above examples, but the invention can vary within the scope of the enclosed claims below. The dependent claims present some possible embodiments of the invention, and they should not be considered as such to limit the scope of the invention.

The invention claimed is:

1. A device for drying and treating a fiber-based moving fiber web in a tissue machine, comprising:

a continuous metal belt mounted for rotation in a continuous rotating cycle about a lower roll and an upper roll positioned above the lower roll, the lower roll and the upper roll being within the continuous metal belt;

wherein the continuous metal belt has a portion which extends upwardly between the lower roll and the upper roll, and a portion which extends downwardly between the upper roll and the lower roll where the continuous metal belt returns to the lower roll;

at least one pressure roll, having a shell, the pressure roll outside the continuous metal belt, the shell in nip contact with the continuous metal belt on the lower roll, the pressure roll arranged to adhere the fiber web to the continuous metal belt when the fiber web passes through the nip contact, so that the continuous metal belt transfers the fiber web to the upper roll;

wherein the upper roll and the lower roll have shells which are in contact with the continuous metal belt which rolls are for supporting the continuous metal belt;

a creping doctor blade arranged against the continuous metal belt so as to detach the fiber web from the continuous metal belt substantially after the downwardly extending portion of the continuous metal belt;

a first impingement hood positioned outside the continuous metal belt which at least partially covers the continuous metal belt where the fiber web is adhered thereto on the upwardly extending portion of the continuous metal belt, and a second impingement hood positioned outside the continuous metal belt which at least partially covers the continuous metal belt where the fiber web is adhered to the downwardly extending portion of the continuous metal belt; and wherein a principal dimension in a horizontal direction is defined by a greatest dimension of the metal belt in the horizontal direction, and a principal dimension in a vertical direction is defined by a greatest dimension of the metal belt in the vertical direction, and wherein the principal dimension in the horizontal direction is substantially smaller than the principal dimension in the vertical direction.

2. The device of claim 1 further comprising a humidifier arranged for treating the fiber web before the fiber web is delivered to the continuous metal belt.

3. The device of claim 1 wherein the fiber web is arranged to first wrap onto the shell of the pressure roll and, supported by the shell of the pressure roll, to pass into the nip between the pressure roll shell and the continuous metal belt.

4. The device of claim 1 wherein the continuous metal belt has a temperature of 100-350 degrees C. at a point of the continuous metal belt before the fiber web is delivered onto the continuous metal belt.

5. The device of claim 1 wherein the fiber web is arranged supported by a fabric before it is delivered into the nip between the pressure roll shell and the continuous metal belt.

6. The device of claim 1 further comprising at least one heating device selected from the group consisting of: a steam chamber, an indirect induction heater and an oil-heated roll, which is arranged to heat the continuous metal belt.

7. The device of claim 6 wherein the at least one heating device is positioned inside the cycle of the continuous metal belt.

8. The device of claim 6 wherein the at least one heating device is positioned outside the cycle of the continuous metal belt.

9. The device of claim 1 further comprising at least one heating device positioned outside the cycle of the continuous metal belt selected from the group consisting of: a steam chamber, an indirect induction heater, air blowings, an oil-heated roll, which is arranged to heat the fiber web.

10. The device of claim 1 wherein the creping doctor blade is arranged against the continuous metal belt on the lower roll.

11. The device of claim 1 wherein the lower roll and the upper roll are thermo rolls heated either internally or externally.

12. A device for drying and treating a fiber-based moving fiber web in a tissue machine, comprising:

a continuous metal belt mounted for rotation in a continuous rotating cycle about at least two rolls within the continuous metal belt;

at least one pressure roll, having a shell, the pressure roll outside the continuous metal belt, the shell in nip contact with the continuous metal belt and arranged to adhere the fiber web to the continuous metal belt when the fiber web passes through the nip contact, so that the continuous metal belt transfers the fiber web in a machine direction;

wherein the at least two rolls have shells which are in contact with the continuous metal belt which rolls are for supporting or controlling the continuous metal belt;

a creping doctor blade arranged against the continuous metal belt so as to detach the fiber web from the continuous metal belt;

an impingement hood positioned outside the continuous metal belt which at least partially covers the continuous metal belt where the fiber web is adhered thereto;

wherein a principal dimension in a horizontal direction is defined by a greatest dimension of the metal belt in the horizontal direction, and a principal dimension in a vertical direction is defined by a greatest dimension of the metal belt in the vertical direction, and wherein the principal dimension in the horizontal direction is substantially smaller than the principal dimension in the vertical direction; and wherein the device includes at least one counter element arranged outside the continuous metal belt to create a contact area between the continuous metal belt and the counter element forming a process zone via which process zone the fiber web is arranged to travel.

13. The device of claim 12, further comprising a press roll inside the continuous metal belt which forms a nip with the counter element to create the process zone.

14. The device of claim 13 wherein a thermo roll is arranged to form one of the press roll or the counter element.

15. The device of claim 14 further comprising at least one heating device selected from the group consisting of: a steam chamber, an indirect induction heater, and an oil-heated roll, which is arranged to heat the thermo roll.

* * * * *